US009307611B2

(12) United States Patent
Tanada

(10) Patent No.: US 9,307,611 B2
(45) Date of Patent: Apr. 5, 2016

(54) PIXEL CIRCUIT, DISPLAY DEVICE, AND ELECTRONIC DEVICE

(71) Applicant: Semiconductor Energy Laboratory Co., Ltd., Atsugi-shi, Kanagawa-ken (JP)

(72) Inventor: Yoshifumi Tanada, Takayama (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 420 days.

(21) Appl. No.: 13/890,357

(22) Filed: May 9, 2013

(65) Prior Publication Data

US 2013/0307421 A1 Nov. 21, 2013

(30) Foreign Application Priority Data

May 18, 2012 (JP) ..... 2012-114506

(51) Int. Cl.

| | |
|---|---|
| ***H05B 37/00*** | (2006.01) |
| ***G09G 3/36*** | (2006.01) |
| *G09G 3/20* | (2006.01) |

(52) U.S. Cl.

CPC ..... *H05B 37/00* (2013.01); *G09G 3/3659* (2013.01); *G09G 3/2022* (2013.01); *G09G 2300/0857* (2013.01)

(58) Field of Classification Search

CPC ..... G09G 3/3233; G09G 2300/0857; G09G 3/2022; G09G 3/3659; H05B 37/00

See application file for complete search history.

(56) References Cited

U.S. PATENT DOCUMENTS

| | | | |
|---|---|---|---|
| 4,036,553 | A | 7/1977 | Borel et al. |
| 4,773,738 | A | 9/1988 | Hayakawa et al. |
| 4,841,294 | A | 6/1989 | Clerc |
| 4,850,676 | A | 7/1989 | Yazaki et al. |
| 5,017,914 | A | 5/1991 | Uchida et al. |
| 5,091,722 | A | 2/1992 | Kitajima et al. |
| 5,157,386 | A | 10/1992 | Uchida et al. |

(Continued)

FOREIGN PATENT DOCUMENTS

| | | |
|---|---|---|
| CN | 001366291 | 8/2002 |
| CN | 001728218 | 2/2006 |

(Continued)

OTHER PUBLICATIONS

International Search Report (Application No. PCT/JP2013/062881) Dated Aug. 13, 2013.

(Continued)

*Primary Examiner* — Abbas Abdulselam

(74) *Attorney, Agent, or Firm* — Robinson Intellectual Property Law Office; Eric J. Robinson

(57) ABSTRACT

An object is to enable application of forward/reverse voltage to or forward/reverse current to a display element and to lower power consumption of a driver circuit for driving a pixel. A memory storing the potential of a source signal line input through a switch, a first transistor whose gate is supplied with one output of the memory, a second transistor whose gate is supplied with the other output of the memory, a display element electrically connected to one of a source a drain of a first transistor and one of a source and a drain of a second transistor, a power source line electrically connected to the other of the source and the drain of the first transistor and the other of the source and the drain of the second transistor, and a counter power source electrically connected to the display element are included.

19 Claims, 12 Drawing Sheets

(56) References Cited

U.S. PATENT DOCUMENTS

| | | | | |
|---|---|---|---|---|
| 5,196,839 | A | 3/1993 | Johary et al. | |
| 5,200,846 | A | 4/1993 | Hiroki et al. | |
| 5,225,823 | A | 7/1993 | Kanaly | |
| 5,287,205 | A | 2/1994 | Yamazaki et al. | |
| 5,325,338 | A | 6/1994 | Runaldue et al. | |
| 5,349,366 | A | 9/1994 | Yamazaki et al. | |
| 5,424,752 | A | 6/1995 | Yamazaki et al. | |
| 5,471,225 | A | 11/1995 | Parks | |
| 5,479,283 | A | 12/1995 | Kaneko et al. | |
| 5,642,129 | A | 6/1997 | Zavracky et al. | |
| 5,712,652 | A | 1/1998 | Sato et al. | |
| 5,798,746 | A | 8/1998 | Koyama | |
| 6,157,356 | A | 12/2000 | Troutman | |
| 6,194,837 | B1 | 2/2001 | Ozawa | |
| 6,259,846 | B1 | 7/2001 | Roach et al. | |
| 6,392,618 | B1 | 5/2002 | Kimura | |
| 6,452,341 | B1 | 9/2002 | Yamauchi et al. | |
| 6,542,138 | B1 | 4/2003 | Shannon et al. | |
| 6,563,480 | B1 | 5/2003 | Nakamura | |
| 6,765,549 | B1 | 7/2004 | Yamazaki et al. | |
| 6,774,876 | B2 | 8/2004 | Inukai | |
| 6,801,177 | B2 | 10/2004 | Kudo et al. | |
| 6,937,222 | B2 | 8/2005 | Numao | |
| 7,834,827 | B2 | 11/2010 | Miyake et al. | |
| 8,400,442 | B2 * | 3/2013 | Yamashita | G09G 3/3233 345/205 |
| 8,791,883 | B2 * | 7/2014 | Ebisuno | G09G 3/3233 345/212 |
| 2002/0093472 | A1 | 7/2002 | Numao | |
| 2003/0057423 | A1 | 3/2003 | Shimoda et al. | |
| 2006/0022900 | A1 | 2/2006 | Miyake et al. | |
| 2007/0229417 | A1 | 10/2007 | Giraldo et al. | |
| 2009/0027310 | A1 * | 1/2009 | Kim | G09G 3/3233 345/76 |
| 2009/0051628 | A1 * | 2/2009 | Kwon | G09G 3/3233 345/77 |
| 2011/0057925 | A1 | 3/2011 | Miyake et al. | |

FOREIGN PATENT DOCUMENTS

| | | | |
|---|---|---|---|
| CN | 001950872 | | 4/2007 |
| JP | 58-143389 | A | 8/1983 |
| JP | 63-096636 | A | 4/1988 |
| JP | 08-194205 | A | 7/1996 |
| JP | 2002-023705 | A | 1/2002 |
| JP | 2002-287718 | A | 10/2002 |
| JP | 2006-065308 | A | 3/2006 |
| JP | 2007-537476 | | 12/2007 |
| KR | 2002-0062218 | A | 7/2002 |
| KR | 2007-0020029 | A | 2/2007 |
| TW | 536689 | | 6/2003 |
| WO | WO-2005/109390 | | 11/2005 |

OTHER PUBLICATIONS

Written Opinion (Application No. PCT/JP2013/062881) Dated Aug. 13, 2013.

* cited by examiner

PIXEL CIRCUIT, DISPLAY DEVICE, AND ELECTRONIC DEVICE

TECHNICAL FIELD

The present invention relates to a pixel circuit. The present invention also relates to a display device and an electronic device each of which includes the pixel circuit.

BACKGROUND ART

A display device such as a liquid crystal display device, which includes a display element with a memory function such as a self-luminous element or an electrophoretic element, and the like attract attention as a flat panel display device, and gradually began to appear in the market as practical devices. Examples of the self-luminous element include an organic light-emitting diode (OLED; also referred to as organic EL element and electroluminescence (EL) element).

In an image display device which performs image display with the use of an element which emits light or exhibits a color by voltage application or current supply, a memory is provided in a pixel in order to suppress power consumption due to repeated screen refresh operation during still image display. Once a still image display on the screen is completed, each display data can be retained in the memory in the pixel thereafter, which eliminates the need for refresh operation and stops the operation of a driver circuit for driving the pixel, so that power consumption can be lowered (Patent Document 1).

REFERENCE

[Patent Document 1] Japanese Published Patent Application No. 2002-23705

DISCLOSURE OF INVENTION

Voltage application or current supply in the direction that is opposite to the direction in the case of normal light emission or color exhibition is needed in some cases for deleting an image, suppressing the deterioration of an element, or the like. For example, voltage application or current supply is performed in such a manner that the direction of voltage or current applied to a pair of electrodes between which a display element is provided is reversed. Such control of voltage or current can be performed by providing a transistor between a power source and one electrode of a display element.

Drive of a transistor is controlled with a potential difference (gate-source voltage) between a potential applied to a gate electrode and a potential applied to a source electrode. When the direction of voltage or current applied to a display element is reversed without careful consideration, the value of the gate-source voltage might be different from a value assumed at the time of design, which causes a problem in that voltage application or current supply in a desired reverse direction cannot be performed.

The above problem is here described using a pixel circuit illustrated in FIG. 7A. The pixel circuit illustrated in FIG. 7A includes a source signal line 12 for inputting a video signal, a switch 15 for controlling input of the video signal to a pixel, a gate signal line 11 for driving the switch 15, a transistor 16 whose gate is supplied with the video signal input to the pixel through the switch 15 and to which voltage is applied or current is supplied from a power source line 13 on the basis of the signal, a display element 17 which is connected to one of a source and a drain of the transistor 16, the power source line 13 which is connected to the other of the source and the drain of the transistor 16 and is for applying voltage or supplying current to the display element 17 through the transistor 16, and a counter power source 14. Further, a transistor is used as the switch 15. Here, a power source, which supplies a counter potential with respect to a potential being supplied to a power source line, is referred to as a counter power source.

FIG. 7B illustrates a state in which a voltage of approximately 10 V is applied to the display element 17 through the transistor 16; when the transistor 16 is a p-channel transistor in this state, the gate-source voltage is determined by $V_{GS}$ in the drawing. In this specification, "$V_{GS}$" refers to a potential difference between a gate electrode and a source electrode with the potential of the source electrode used as a reference potential.

Meanwhile, as illustrated in FIG. 7C, in the case where reverse voltage is applied to the display element 17 with the same structure as FIG. 7B, the potentials of the power source line 13 and the counter power source 14 are reversed; thus, the gate-source voltage of the transistor 16 is determined by $V_{GS}$ in the drawing. The potential on the source side is substantially 0 V, which does not make a sufficient potential difference from a 0 V signal input to the gate of the transistor 16; thus, reverse current cannot flow sufficiently. Further, it is clear that current cannot flow sufficiently in either direction even when the polarity of the transistor 16 is reversed (i.e., the transistor 16 is an n-channel transistor).

In view of the above problem, an object of one embodiment of the present invention is to enable application of forward/reverse voltage or supply of forward/reverse current to a display element and to lower power consumption of a driver circuit for driving a pixel.

One embodiment of the present invention is a pixel circuit which includes a first wiring, a switch which is electrically connected to the first wiring, a second wiring for driving the switch; a memory which stores the potential of the first wiring input through the switch, a first transistor whose gate is supplied with one output of the memory, a second transistor whose gate is supplied with the other output of the memory, a display element which is electrically connected to one of a source and a drain of the first transistor and one of a source and a drain of the second transistor, a third wiring which is electrically connected to the other of the source and the drain of the first transistor and the other of the source and the drain of the second transistor, and a counter power source which is electrically connected to the display element. The polarity of the first transistor is different from the polarity of the second transistor. The other output of the memory is an inverted output of the one output of the memory.

Another embodiment of the present invention is a pixel circuit which includes a first wiring; a first transistor which is controlled when the potential of the first wiring is input to a gate of the first transistor; a second transistor for controlling input of the potential of the first wiring to a pixel; a second wiring which is electrically connected to a gate of the second transistor; a memory which stores the potential of the first wiring input through the second transistor; a third wiring, a fourth wiring, and a fifth wiring which are electrically connected to the memory; a third transistor and a fourth transistor which are electrically connected to the memory; a display element which is electrically connected to one of a source and a drain of the third transistor and one of a source and a drain of the fourth transistor; a sixth wiring which is electrically connected to the other of the source and the drain of the third transistor and the other of the source and the drain of the fourth transistor; and a counter power source which is electrically connected to the display element. The memory includes a fifth transistor, a sixth transistor, a seventh transistor, an eighth transistor, and a ninth transistor. One of a source and a drain of the first transistor is electrically connected to the third wiring. The other of the source and the drain of the first transistor is electrically connected to one of a source and a drain of the second transistor. The other of the source and the drain of the second transistor is electrically connected to a gate of the fourth transistor, one of a source and a drain of the fifth transistor, one of a source and a drain of the sixth transistor, a gate of the eighth transistor, and a gate of the ninth transistor. The other of the source and the drain of the fifth transistor is electrically connected to the fifth wiring. A gate of the fifth transistor is electrically connected to a gate of the third transistor, a gate of the sixth transistor, one of a source and a drain of the eighth transistor, and one of a source and a drain of the ninth transistor. The other of the source and the drain of the sixth transistor is electrically connected to one of a source and a drain of the seventh transistor. A gate of the seventh transistor is electrically connected to the second wiring. The fourth wiring is electrically connected to the other of the source and the drain of the seventh transistor and the other of the source and the drain of the ninth transistor. The other of the source and the drain of the eighth transistor is electrically connected to the third wiring. The polarity of the third transistor is different from the polarity of the fourth transistor.

In the above structure, one of the third wiring and the fourth wiring is a power source line to which positive voltage is applied, and the other of the third wiring and the fourth wiring is a power source line to which 0 V or negative voltage is applied.

In the above structure, the first transistor, the second transistor, the fifth transistor, and the eighth transistor have the same polarity as the third transistor, and the sixth transistor, the seventh transistor, and the ninth transistor have the same polarity as the fourth transistor.

Another embodiment of the present invention is a display device including the pixel circuit with the above structure.

Another embodiment of the present invention is an electronic device which includes a panel including the above display device.

One embodiment of the present invention makes it possible to apply forward/reverse voltage or to supply forward/reverse current to a display element and to lower power consumption of a driver circuit for driving a pixel.

BEST MODE FOR CARRYING OUT THE INVENTION

Figure 1A:
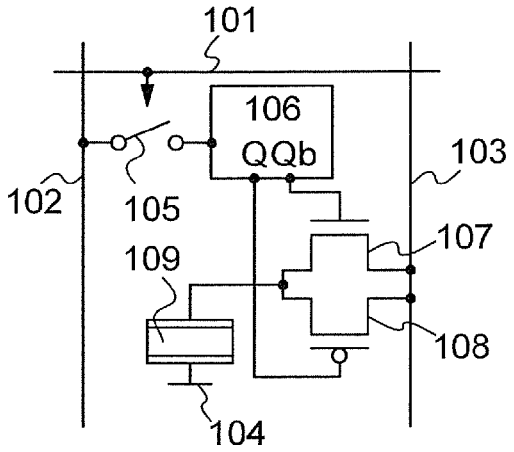
FIGS. 1A to 1C illustrate a pixel circuit of one embodiment of the present invention.

Hereinafter, embodiments of the present invention will be described in detail with reference to the accompanying drawings. Note that the present invention is not limited to the description below, and it is easily understood by those skilled in the art that a variety of changes and modifications can be made without departing from the spirit and scope of the present invention. Therefore, the present invention should not be construed as being limited to the description of the embodiments below.

Note that functions of the "source" and "drain" may be switched in the case where, for example, transistors of different polarities are employed or where the direction of a current flow changes in circuit operation. Therefore, the terms "source" and "drain" can be replaced with each other in this specification.

Note that in this specification and the like, the term "electrically connected" includes the case where components are connected through an "object having any electric function". There is no particular limitation on the object having any electric function as long as electric signals can be transmitted and received between the components connected through the object.

The position, size, range, or the like of each component illustrated in drawings and the like is not accurately represented in some cases for easy understanding. Therefore, the disclosed invention is not necessarily limited to the position, size, range, or the like as disclosed in the drawings and the like.

Ordinal numbers such as "first", "second", and "third" are used in order to avoid confusion among components.

(Embodiment 1)

In this embodiment, an example of a pixel circuit of one embodiment of the present invention will be described with reference to FIGS. 1A to 1C. FIG. 1A is a basic conceptual diagram of a pixel circuit.

The pixel circuit illustrated in FIG. 1A includes a source signal line 102 for inputting a video signal to a pixel, a switch 105 for controlling input of the video signal to the pixel, a gate signal line 101 which drives the switch 105, a memory 106 which stores the video signal input to the pixel through the switch 105, a transistor 107 whose gate is supplied with one output of the memory 106, a transistor 108 whose gate is supplied with the other output of the memory 106, a display element 109 which is electrically connected to one of a source and a drain of the transistor 107 and one of a source and a drain of the transistor 108, a power source line 103 which is electrically connected to the other of the source and the drain of the transistor 107 and the other of the source and the drain of the transistor 108, and a counter power source 104 which is electrically connected to the display element 109. Further, a transistor is used as the switch 105.

The transistor 107 is an n-channel transistor, and the transistor 108 is a p-channel transistor.

The operation of the pixel circuit illustrated in FIG. 1A is specifically described with reference to FIGS. 1B and 1C.

First, the operation up to and including retention of a video signal in the memory 106 is described.

When the switch 105 is turned on by a signal output from the gate signal line 101, a video signal input from the source signal line 102 through the switch 105 is stored in the memory 106.

The memory 106 can retain the stored video signal even after the switch 105 is turned off.

Figure 1B:
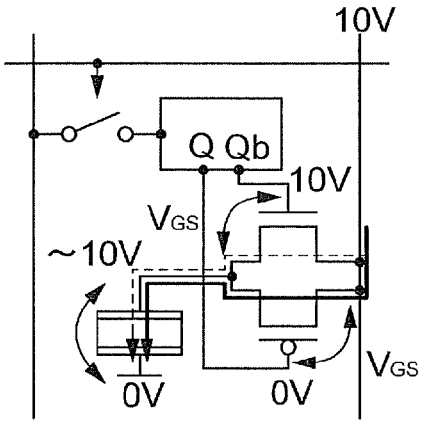

Next, the following case illustrated in FIG. 1B are considered: 10 V is applied to the power source line 103, 0 V is applied to the counter power source 104, and voltage is applied to the display element 109; or 10 V is applied to the power source line 103, 0 V is applied to the counter power source 104, and current flowing toward the counter power source 104 is supplied from the power source line 103 to the display element 109.

When a signal which makes the pixel emit light or exhibit a color is input from the source signal line 102 to the memory 106, the memory 106 outputs 0 V which is an L-level potential from a terminal Q and outputs 10 V which is an H-level potential from a terminal Qb in accordance with the input video signal. The L-level potential from the terminal Q is input to a gate of the transistor 108, and the H-level potential from the terminal Qb is input to a gate of the transistor 107.

Since the transistor 107 is an n-channel transistor and the transistor 108 is a p-channel transistor, $V_{GS}$ of each of the transistors 107 and 108 at this time is determined as illustrated in FIG. 1B. The potential of the source of the transistor 107 increases to almost 10 V with respect to 10 V input to the gate; thus, $V_{GS}$ is almost 0 V. The potential of the source of the transistor 108 is equal to 10 V which is the potential of the power source line 103 with respect to 0 V input to the gate; thus, $V_{GS}$ is −10 V. Thus, the current supply to the display element 109 is dominated by the transistor 108.

Figure 1C:
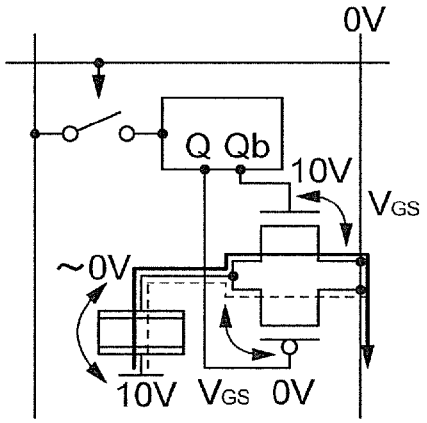

Next, the following case illustrated in FIG. 1C is considered: 0 V is applied to the power source line 103, 10 V is applied to the counter power source 104, and voltage is applied to the display element 109 in the direction opposite to that in FIG. 1B; or 0 V is applied to the power source line 103, 10 V is applied to the counter power source 104, and current flowing toward the power source line 103 is supplied from the counter power source 104.

Input of a video signal and the operation of the memory 106 corresponding thereto are performed as described above.

$V_{GS}$ of each of the transistors 107 and 108 at this time is determined as illustrated in FIG. 1C. Since the potentials applied to the power source line 103 and the counter power source 104 are opposite to those in FIG. 1B, the potential of the source of the transistor 107 is equal to 0 V which is the potential of the power source line 103 with respect to 10 V input to the gate; thus, $V_{GS}$ is 10 V. The potential of the source of the transistor 108 decreases to almost 0 V with respect to 0 V input to the gate; thus, $V_{GS}$ is almost 0 V. Thus, the current supply flowing to the display element 109 is dominated by the transistor 107.

As described above, in either case, one of the transistor 107 and the transistor 108 which can be normally turned on is made dominant so that forward/reverse voltage can be applied to or forward/reverse current can be supplied to the display element 109. In addition, since each display data can be retained in the memory 106 in the pixel, refresh operation is not needed and the operation of a driver circuit for driving the pixel can be stopped, which results in lower power consumption.

The structures, methods, and the like described in this embodiment can be combined as appropriate with any of the structures, methods, and the like described in the other embodiments.

(Embodiment 2)

Figure 2:
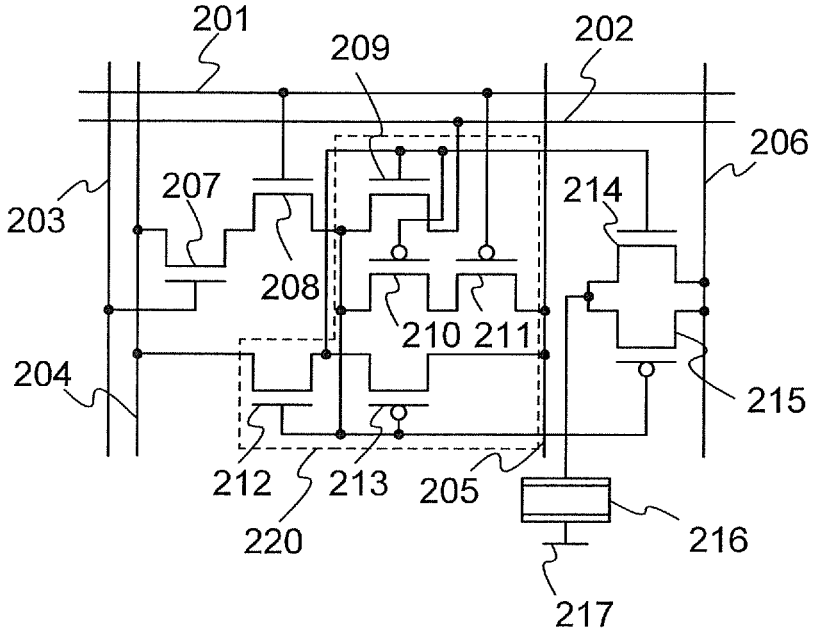
FIG. 2 illustrates a pixel circuit of one embodiment of the present invention.

In this embodiment, an example of a pixel circuit of another embodiment of the present invention will be described with reference to FIG. 2. FIG. 2 illustrates a structure of a pixel circuit.

The pixel circuit illustrated in FIG. 2 includes a source signal line 203 for inputting a video signal to a pixel; a transistor 207 which is controlled when the potential of the source signal line 203 is input to a gate of the transistor 207; a transistor 208 for controlling input of the potential of the source signal line 203 to the pixel; a gate signal line 201 which is electrically connected to a gate of the transistor 208; a memory 220 which stores the video signal input to the pixel through the transistor 208; a power source line 204, a power source line 205, and a gate signal line 202 which are electrically connected to the memory 220; a transistor 214 and a transistor 215 which are electrically connected to the memory 220; a display element 216 which is electrically connected to one of a source and a drain of the transistor 214 and one of a source and a drain of the transistor 215; a power source line 206 which is electrically connected to the other of the source and the drain of the transistor 214 and the other of the source and the drain of the transistor 215; and a counter power source 217 which is electrically connected to the display element 216.

The memory 220 includes a transistor 209, a transistor 210, a transistor 211, a transistor 212, and a transistor 213.

Described below is the connection relation of each component. One of a source and a drain of the transistor 207 is electrically connected to the power source line 204. The other of the source and the drain of the transistor 207 is electrically connected to one of a source and a drain of the transistor 208. The other of the source and the drain of the transistor 208 is electrically connected to a gate of the transistor 215, one of a source and a drain of the transistor 209, one of a source and a drain of the transistor 210, a gate of the transistor 212, and a gate of the transistor 213. The other of the source and the drain of the transistor 209 is electrically connected to the gate signal line 202. A gate of the transistor 209 is electrically connected to a gate of the transistor 214, a gate of the transistor 210, one of a source and a drain of the transistor 212, and one of a source and a drain of the transistor 213. The other of the source and the drain of the transistor 210 is electrically connected to one of a source and a drain of the transistor 211. A gate of the transistor 211 is electrically connected to the gate signal line 201. The power source line 205 is electrically connected to the other of the source and the drain of the transistor 211 and the other of the source and the drain of the transistor 213. The other of the source and the drain of the transistor 212 is electrically connected to the power source line 204.

The transistors 207, 208, 209, 212, and 214 are n-channel transistors, and the transistors 210, 211, 213, and 215 are p-channel transistors. The power source lines 204 and 205 supply power to the memory 220. The power source line 204 is a power source line to which 0 V or negative voltage is applied, and the power source line 205 is a power source line to which positive voltage is applied. Here, 0 V and 10 V are input to the power source lines 204 and 205, respectively.

The gate signal line 202 is supplied with an L-level potential in a normal mode and supplied with an H-level potential in a pulse output mode. When the gate signal line 202 is supplied with an H-level potential, output logic of the memory 220 is forcibly fixed at one value by turning on the transistor 209. Specifically, the gate of the transistor 215 is forcibly supplied with an H-level potential by turning on the transistor 209, and the gate of the transistor 214 is forcibly supplied with an L-level potential by turning on the transistor 212.

The transistor 207 is controlled by a video signal output from the source signal line 203. When the potential of the video signal is at H-level, the transistor 207 is turned on and loads a negative power supply potential of the power source line 204. On the other hand, when the potential of the video signal is at L-level, the transistor 207 is turned off.

Next, the operation of pixel circuits arranged in a matrix will be specifically described with reference to FIG. 3, FIGS. 4A to 4C, and FIGS. 5A and 5B.

Figure 3:
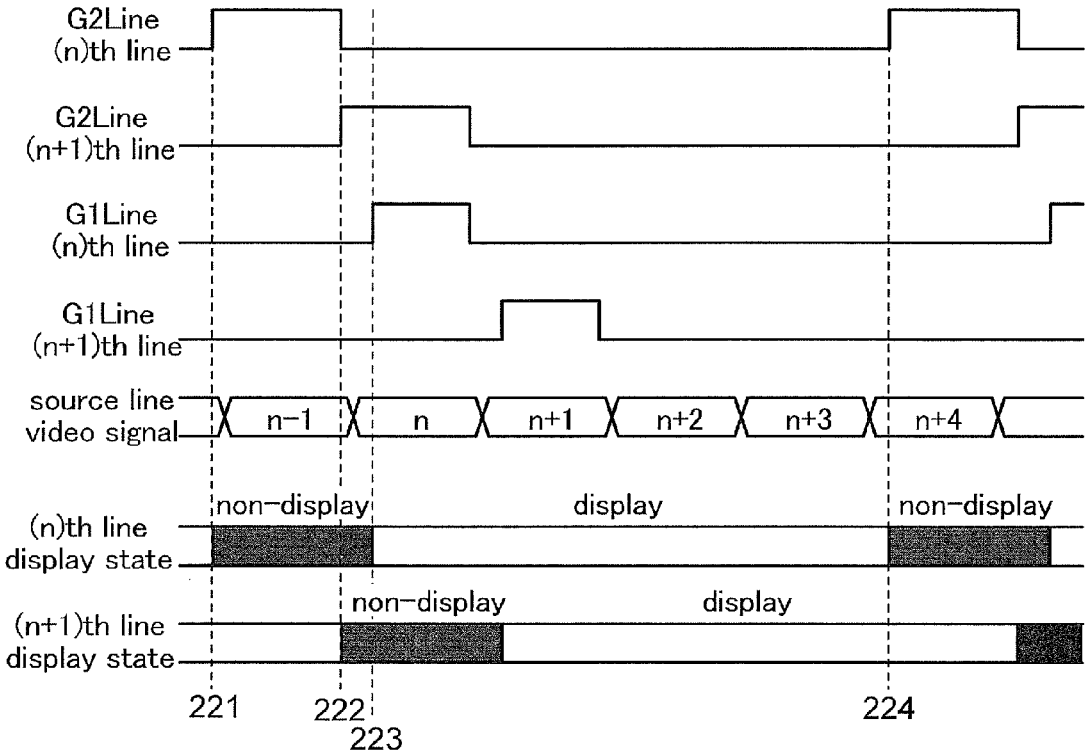
FIG. 3 is a timing chart illustrating an example of operation of a pixel circuit of one embodiment of the present invention.

First, at the point 221 in a timing chart of FIG. 3, the gate signal line 202 in the n-th row (G2Line in FIG. 3) is supplied with an H-level potential, so that the transistor 212 is turned on by turning on the transistor 209, and a negative power supply potential (L-level potential) is input to the gate of the transistor 214 from the power source line 204, so that the transistor 214 is turned off. In addition, an H-level potential is input to the gate of the transistor 215 from the gate signal line 202 through the transistor 209, so that the transistor 215 is turned off.

Figure 4A:
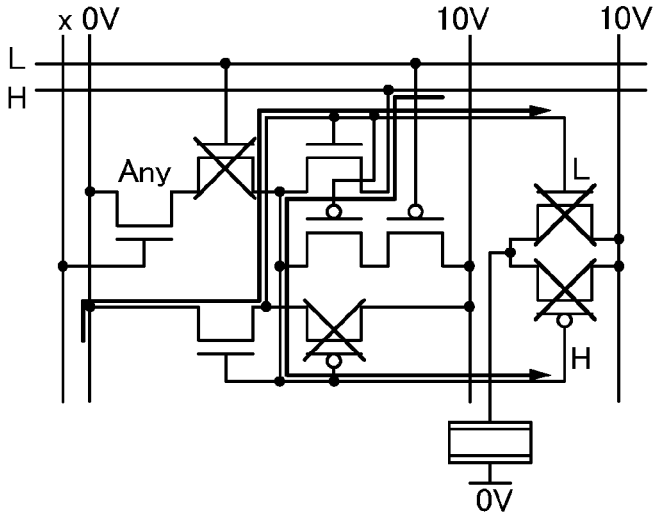
FIGS. 4A to 4C each illustrate an example of operation of a pixel circuit of one embodiment of the present invention.

The pixels in the row in which the above operation has been completed are in a state in which voltage is not applied to or current is not supplied to the display element 216, that is, a non-display state. Although the above operation is terminated when the gate signal line 202 in the row is supplied with an L-level potential, the pixels in the row maintain the non-display state with the use of the memory 220 including the transistors 209, 210, 211, 212, and 213 until the next processing starts (FIG. 4A; reset state).

Since the transistor 208 is off at this time, the transistor 207 may be turned on or is not necessarily turned on by a signal potential of the source signal line 203 (the transistor 207 is denoted by "Any" in the drawing). Note that the transistor which is off is denoted by a cross mark (x) in the drawing.

Next, at the point 223 in the timing chart of FIG. 3, the gate signal line 201 in the n-th row (G1Line in FIG. 3) is supplied with an H-level potential, so that the transistor 208 is turned on. If the potential of a video signal supplied to the source signal line 203 (or an output signal based on a video signal) is at H-level at this time, the transistor 207 is turned on; thus, a negative power supply potential (L-level potential) from the power source line 204 is input to the gates of the transistors 212, 213, and 215 through the transistor 208 which has been turned on.

Figure 4B:
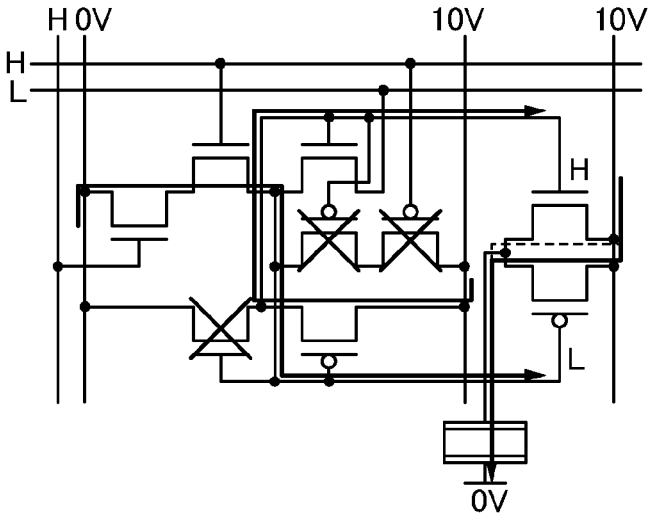
Figure 4C:
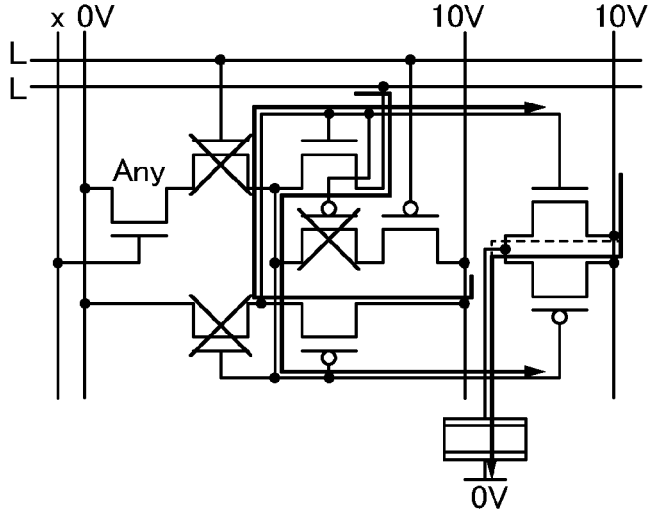

The transistor 213 is turned on as a result, so that a positive power supply potential (H-level potential) supplied to the power source line 205 is input to the gates of the transistors 209, 210, and 214 (FIG. 4B; video signal input (positive polarity) state).

On the other hand, if the potential of the video signal supplied to the source signal line 203 (or the output signal based on the video signal) is at L-level, the transistor 207 is turned off, so that the state of the pixels is not changed.

In the case where the transistors 214 and 215 are turned on as a result of the operation, voltage is applied to or current is supplied from the power source line 206 (10 V) to the display element 216 through the transistors 214 and 215, so that light is emitted or a color is exhibited. On the other hand, in the case where the transistors 214 and 215 are off, the display element 216 does not operate.

In the above manner, display is performed by the video signal supplied to the source signal line 203 (or the output signal based on the video signal). At this time, as in a similar manner, the pixels in the row maintain the video signal input state with the use of the memory 220 including the transistors 209, 210, 211, 212, and 213 until the next processing starts or after the transistor 208 is turned off (FIG. 4C; display retention (positive polarity) state).

Since the transistor 208 is off at this time, as described above, the transistor 207 may be turned on or is not necessarily turned on by a signal potential of the source signal line 203.

After the above state (retention state) has been kept for a while, at the point 224, the gate signal line 202 is again supplied with an H-level potential, so that the transistors 214 and 215 are turned off.

As a result of this operation, all of the pixels including the pixels which is emitting light or exhibiting colors are forcibly fixed to a non-display state, so that the display period is terminated. After that, a similar operation is sequentially performed on the pixels in the rest of the rows, whereby display on the screen is completed (returning to the reset state in FIG. 4A). A similar processing is performed on the pixels in the (n+1)-th row and subsequent rows.

Further, pulses are sequentially output to the gate signal lines 201 (G1Line) and the gate signal lines 202 (G2Line) so that pulses output to the gate signal lines 201 (G1Line) in different rows do not overlap and that pulses output to the gate signal lines 202 (G2Line) in different rows do not overlap. For this reason, at the point 222 in the timing chart of FIG. 3, the gate signal line 202 (G2Line) in the (n+1)-th row is supplied with an H-level potential.

Furthermore, the pixels are reset by the pulses output to the gate signal line 202 (G2Line), and then a time lag between the output of pulses to the gate signal line 202 (G2Line) and the output of pulses to the gate signal line 201 (G1Line) is made so that the pixels are brought into a writing selection state by the gate signal line 201 (G1Line). In other words, data writing to the pixels in the n-th row and the reset of the pixels in the (n+1)-th row are performed at the same timing.

Although the state when forward voltage (from the power source line 206 to the counter power source 217) is applied to the display element or forward current is supplied (positive polarity) is described above, reverse voltage (from the counter power source 217 to the power source line 206) is applied or reverse current is supplied (negative polarity) in the same sequence.

Figure 5A:
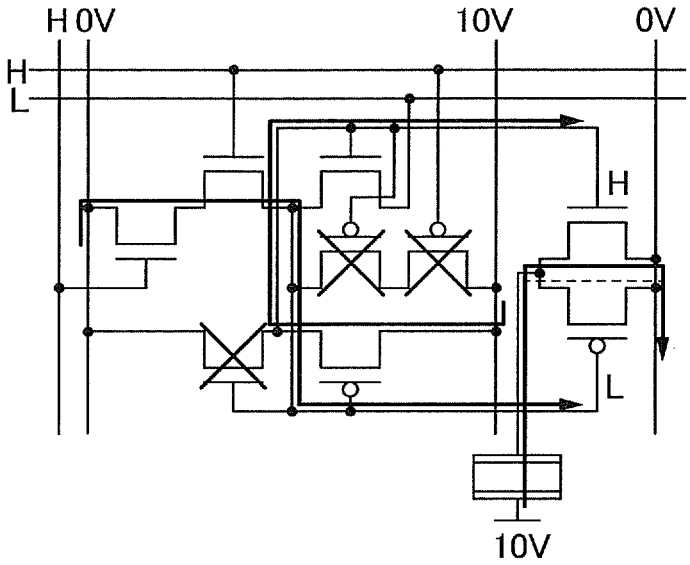
FIGS. 5A and 5B each illustrate an example of operation of a pixel circuit of one embodiment of the present invention.

FIG. 5A illustrates a video signal input (negative polarity) state. The on and off states of the transistors are the same as those in the video signal input (positive polarity) state; however, the dominant transistor and the path at the time of voltage application or current supply to the display element 216 are different from those in the video signal input (positive polarity) state.

Figure 5B:
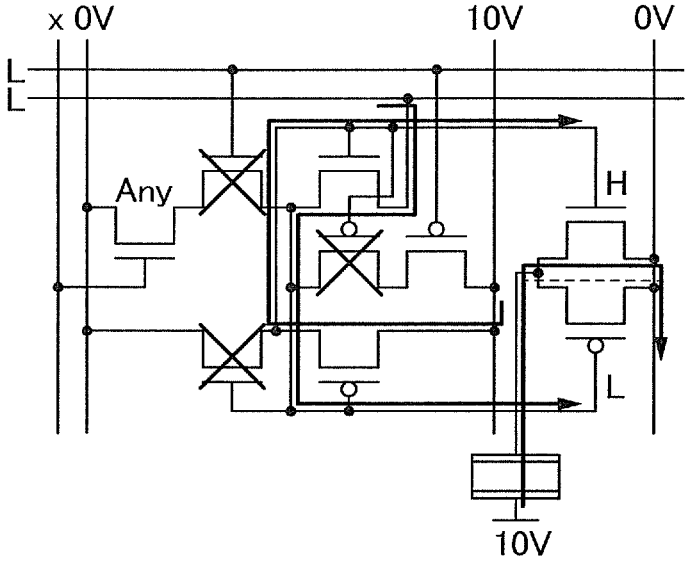

FIG. 5B illustrates a display retention (negative polarity) state. The on and off states of the transistors are the same as those in the display retention (positive polarity) state; however, the dominant transistor and the path at the time of voltage application or current supply to the display element 216 are different from those in the display retention (positive polarity) state.

In the case where the transistors 214 and 215 are turned on as a result of the operation, reverse voltage is applied to or reverse current is supplied to the display element 216 from the counter power source 217 (10 V). On the other hand, in the case where the transistors 214 and 215 are off, the above operation is not performed.

As described above, in either case, one of the transistors 214 and 215 which can be normally turned on is made dominant so that forward/reverse voltage can be applied to or forward/reverse current can be supplied to the display element 216. In addition, since each display data can be retained in the memory 220 in the pixel, refresh operation is not needed and the operation of a driver circuit for driving the pixel can be stopped, which results in lower power consumption.

The structures, methods, and the like described in this embodiment can be combined as appropriate with any of the structures, methods, and the like described in the other embodiments.

(Embodiment 3)

In a display device including the pixel circuit described in Embodiment 2, each pixel can be in either of the two states: a state in which both the transistor 214 and the transistor 215 are turned on and a state in which both are turned off. In these states, the level of a color for the pixel is 0% (black) or 100% (e.g., white), which means that only black or white can be displayed and shades of gray cannot be displayed. In this embodiment, an example of a method of displaying shades of gray by combining a time-ratio grayscale method will be described with reference to FIGS. 6A and 6B.

Figure 6A:
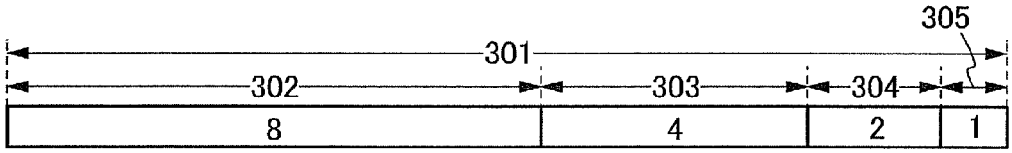
FIGS. 6A and 6B show a time-ratio grayscale method.

First, as illustrated in FIG. 6A, one frame period 301 which is a minimum unit of image display is divided into four periods. The divided four periods are here referred to as a subframe period 302, a subframe period 303, a subframe period 304, and a subframe period 305.

In each of the subframe periods 302 to 305, the level of a color for the pixel is either 0% (black) or 100% (white) as described above.

The subframe periods 302 to 305 have different lengths. In an example illustrated in FIG. 6A, the length ratio of the subframe period 302 to the subframe period 303, the subframe period 304, and the subframe period 305 is 8:4:2:1.

A signal with 4 bits of data (16 shades of gray) is used, and each bit corresponds to each subframe period. In accordance with the video signal, the level of a color for the pixel becomes either 0% (black) or 100% (white) in each subframe period, and shades of gray are displayed on the basis of the proportion of the period in which the level of a color for the pixel is 100% (white) in the frame period 301.

Figure 6B:
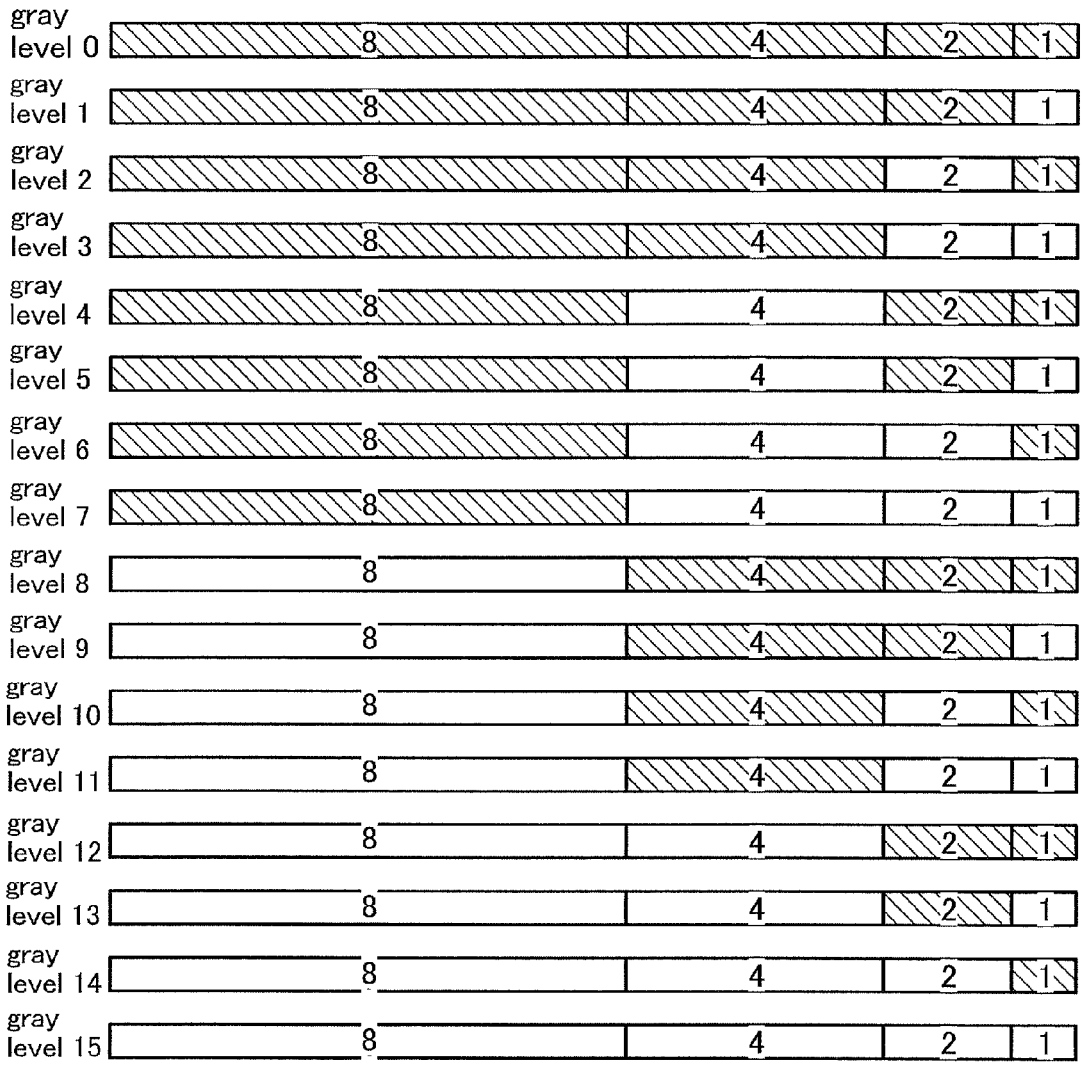
Figure 7A:
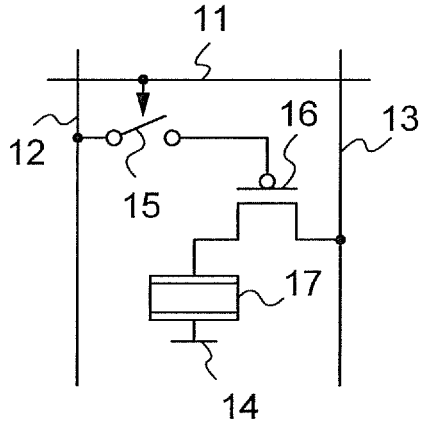
FIGS. 7A to 7C illustrate a conventional pixel circuit.
Figure 7B:
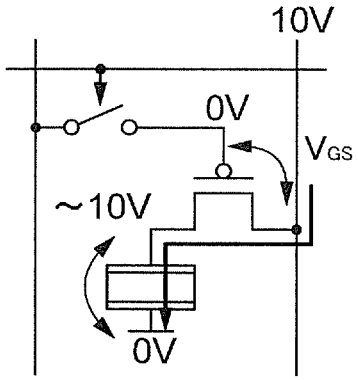
Figure 7C:
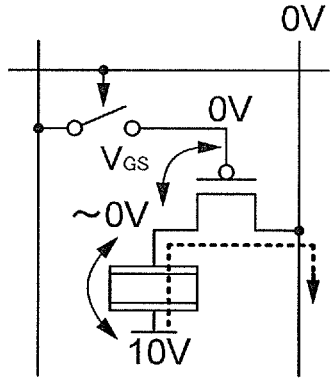

As illustrated in FIG. 6B, if control is performed under the condition that the level of a color for the pixel is either 0% (black) or 100% (white) in each subframe period, 16 shades of gray can be displayed with all combinations of subframe periods.

In the case where a reverse bias is applied to the display element in the pixel of one embodiment of the present invention, the same driving as that described above may be performed with the potentials of the power source line 206 and the counter power source 217 switched. Control is performed on the basis of the same video signal, whereby the reverse bias can be applied to the pixel for the same length of time as the case of forward bias application.

In this embodiment, when a signal with m bits of data is used, a frame period is divided into m subframe periods and the length ratio between the subframe periods is set to $2^{(m-1)}:2^{(m-2)}:2^{(m-3)}:\ldots:2^1:2^0$ to display shades of gray; however, the number of divided subframe periods, the division ratio between the subframe periods, and the like are not limited thereto, and the display of shades of gray may be performed in combination with a known time-ratio grayscale method.

The structures, methods, and the like described in this embodiment can be combined as appropriate with any of the structures, methods, and the like described in the other embodiments.

(Embodiment 4)

In this embodiment, examples of display devices including a pixel circuit which is one embodiment of the present invention will be described with reference to FIG. 8, FIG. 9, FIG. 10, and FIG. 11.

Figure 8:
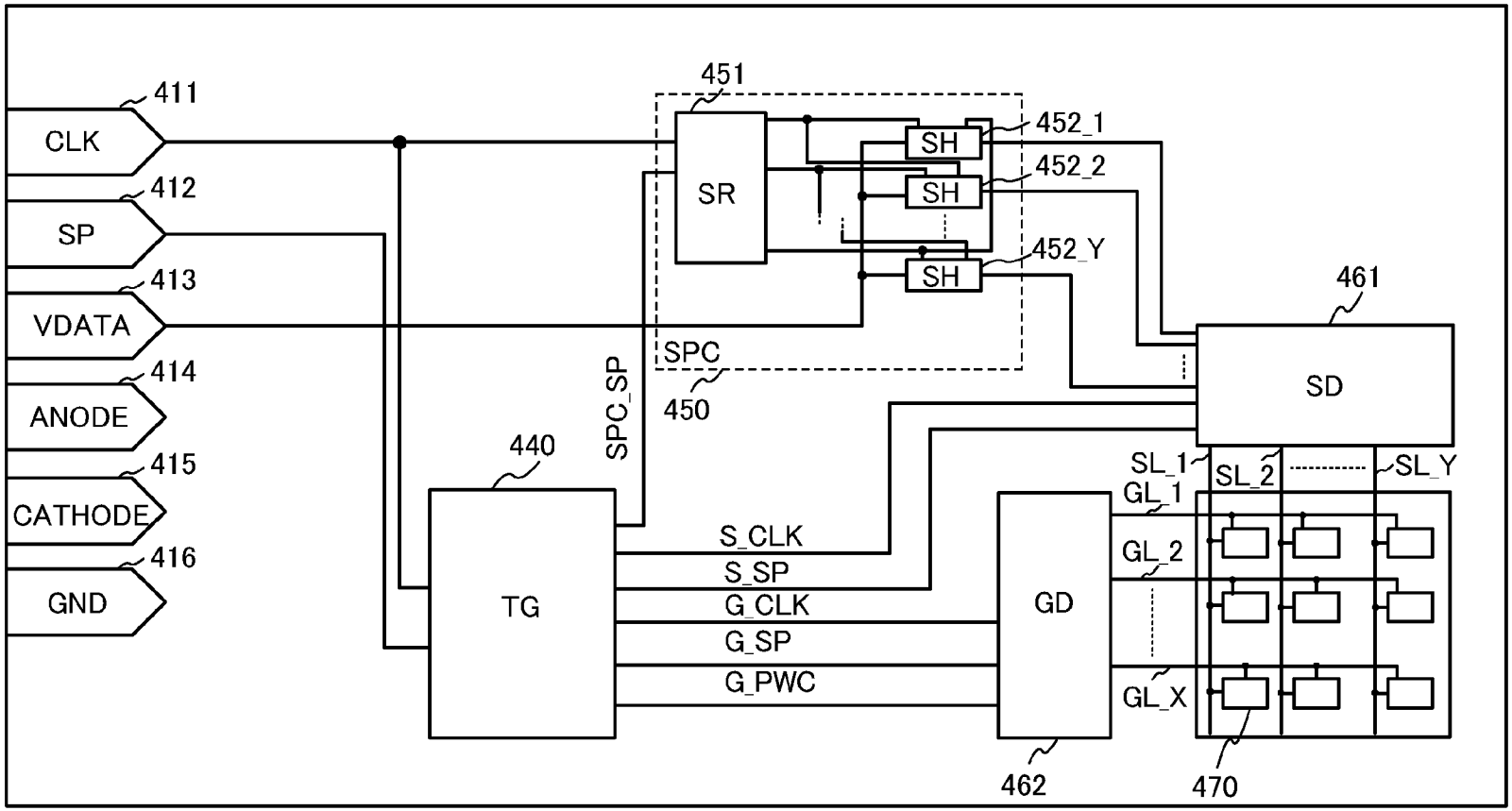
FIG. 8 illustrates an example of a structure of a display device.

FIG. 8 is a block diagram of a display device in this embodiment. The display device illustrated in FIG. 8 includes a clock signal input terminal 411 which inputs a clock signal; a start pulse signal input terminal 412 which inputs a start pulse signal; a data signal input terminal 413 which inputs a data signal; an anode terminal 414 which supplies an anode potential (Anode); a cathode terminal 415 which supplies a cathode potential (Cathode); a ground terminal 416 which supplies a ground potential (GND); a control circuit 440 (also referred to as TG); a signal converter circuit 450 (also referred to as SPC); a source driver 461 (also referred to as SD); a gate driver 462 (also referred to as GD); and a plurality of pixel circuits 470. Note that in the display device illustrated in FIG. 8, any of an anode potential, a cathode potential, and a ground potential is supplied as appropriate to the control circuit 440, the signal converter circuit 450, the source driver 461, the gate driver 462, and the plurality of pixel circuits 470 through any of the anode terminal 414, the cathode terminal 415, and the ground terminal 416.

A clock signal CLK and a start pulse signal SP are input to the control circuit 440. For example, the clock signal CLK may be input to the control circuit 440 through the clock signal input terminal 411, and the start pulse signal SP may be input to the control circuit 440 through the start pulse signal input terminal 412.

The control circuit 440 generates and outputs a start pulse signal SPC_SP, a clock signal S_CLK, a start pulse signal S_SP, a clock signal G_CLK, a start pulse signal G_SP, and a plurality of control signals G_PWC in accordance with the clock signal CLK and the start pulse signal SP. Note that as the plurality of control signals G_PWC, a plurality of clock signals having phases different from each other may be generated.

The control circuit 440 has a function of controlling the operation of the signal converter circuit 450, the source driver 461, and the gate driver 462.

A video data signal VDATA, the clock signal CLK, and the start pulse signal SPC_SP are input to the signal converter circuit 450. For example, the video data signal VDATA may be input to the signal converter circuit 450 through the data signal input terminal 413, and the clock signal CLK may be input to the signal converter circuit 450 through the clock signal input terminal 411.

The signal converter circuit 450 has a function of converting the input video data signal VDATA into a first to Y-th (Y is a natural number greater than or equal to 2) data signals which are parallel data signals and outputting them.

The signal converter circuit 450 includes a shift register 451 which generates and outputs a plurality of sampling control signals SMP in accordance with the clock signal CLK and the start pulse signal SPC_SP; and a plurality of sample-and-hold circuits 452 (sample-and-hold circuits 452_1 to 452_Y) in each of which extraction and retention of one of the video data signals VDATA are controlled in accordance with any of the plurality of sampling control signals SMP. The clock signal CLK and the start pulse signal SPC_SP are input to the shift register 451. Note that the plurality of shift registers 451 may be provided, and at least one of the sample-and-hold circuits 252_1 to 252_Y may be controlled by a sampling control signal SMP output from one shift register 451, and the rest of them may be each controlled by a sampling control signal SMP output from another shift register 451.

The first to Y-th data signals, which form a parallel data signal, the clock signal S_CLK, and the start pulse signal S_SP are input to the source driver 461. The source driver 461 has a function of sequentially outputting the input first to Y-th data signals in accordance with the clock signal S_CLK and the start pulse signal S_SP.

The clock signal G_CLK, the start pulse signal G_SP, and the plurality of control signals G_PWC are input to the gate driver 462. The gate driver 462 has a function of generating and outputting a plurality of gate signals in accordance with the clock signal G_CLK, the start pulse signal G_SP, and the plurality of control signals G_PWC. At this time, the plurality of control signals G_PWC are used for controlling the timing of output of pulses of the plurality of gate signals and the pulse widths.

The plurality of gate signals are input to the respective pixel circuits 470 through a plurality of gate signal lines GL (gate signal lines GL_1 to GL_X (X is a natural number greater than or equal to 2)). Further, one of the first to Y-th data signals is input to any of the plurality of pixel circuits 470 in accordance with one of the plurality of gate signals through any of the plurality of source signal lines SL (source signal lines SL_1 to SL_Y). The plurality of pixel circuits 470 is in a display state corresponding to data of the input data signal.

As the pixel circuit 470, a pixel circuit including a liquid crystal element or a pixel circuit including an electroluminescence element (also referred to as EL element) can be used; for example, any of the pixel circuits described in the above embodiments can be used.

Figure 9:
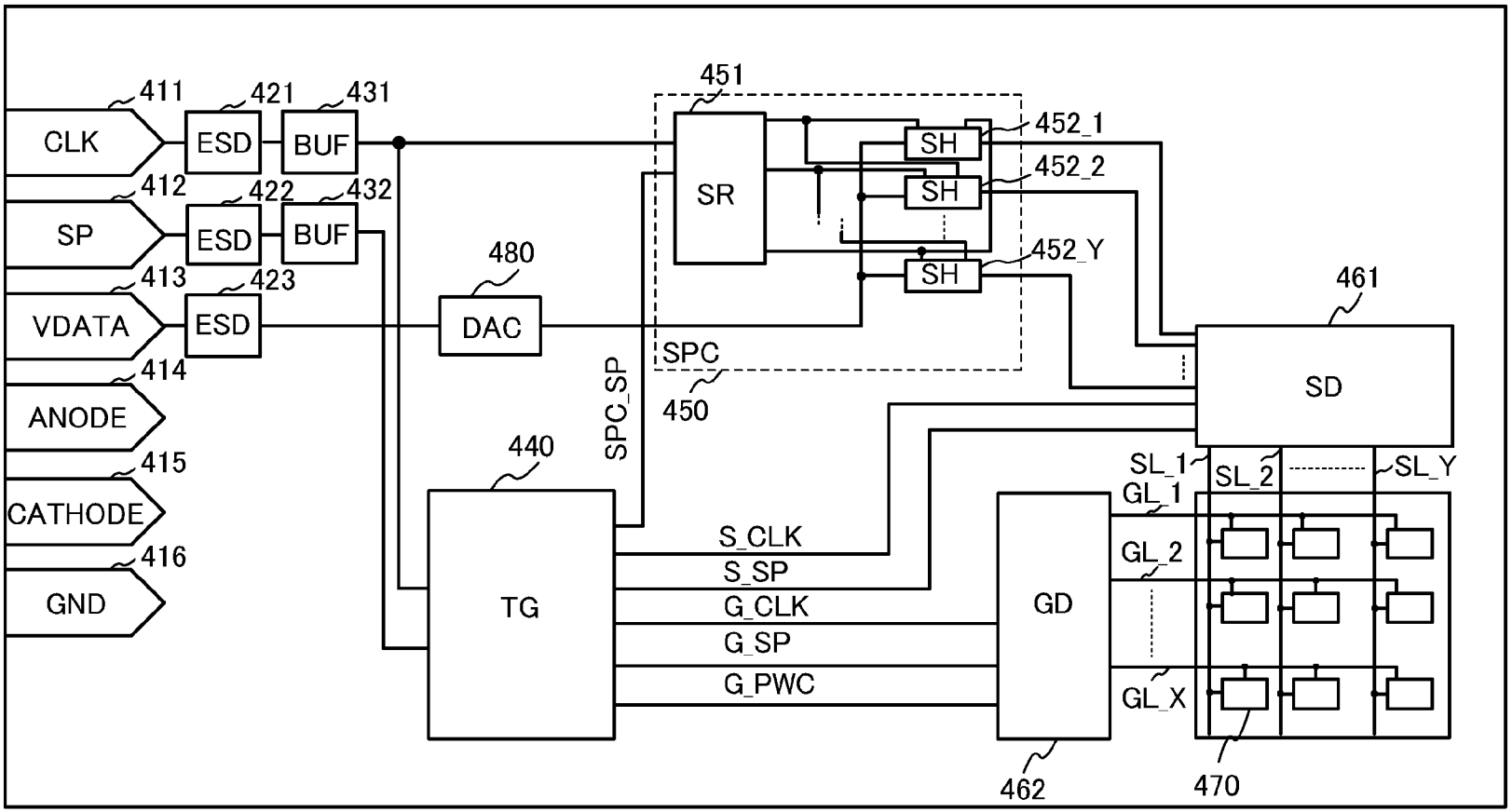
FIG. 9 illustrates an example of a structure of a display device.

Note that as illustrated in FIG. 9, an electrostatic discharge (ESD) protection circuit 421 and a buffer circuit 431 may be provided between the clock signal input terminal 411 and the control circuit 440 and between the clock signal input terminal 411 and the signal converter circuit 450. Further, an ESD protection circuit 422 and a buffer circuit 432 may be provided between the start pulse signal input terminal 412 and the control circuit 440.

In the case where the video data signal VDATA is a digital signal, as illustrated in FIG. 9, the video data signal VDATA input to the signal converter circuit 450 may be converted into an analog data signal by a digital-analog signal converter circuit 480 (also referred to as DAC). An ESD protection circuit 423 may be provided between the data signal input terminal 413 and the signal converter circuit 450 (or the digital-analog signal converter circuit 480).

In the examples of the display devices in this embodiment, which are illustrated in FIG. 8 and FIG. 9, the use of any of the pixel circuits described in the above embodiments makes it possible to apply forward/reverse voltage to or supply forward/reverse current to a display element in the pixel circuit. In addition, a still image can be retained in the memory provided in each pixel circuit without performing screen refresh operation, which results in lower power consumption of a driver circuit for driving the pixel.

Further, examples of structures of the display devices of this embodiment will be described with reference to schematic cross-sectional views of FIG. 10 and FIG. 11.

Figure 10:
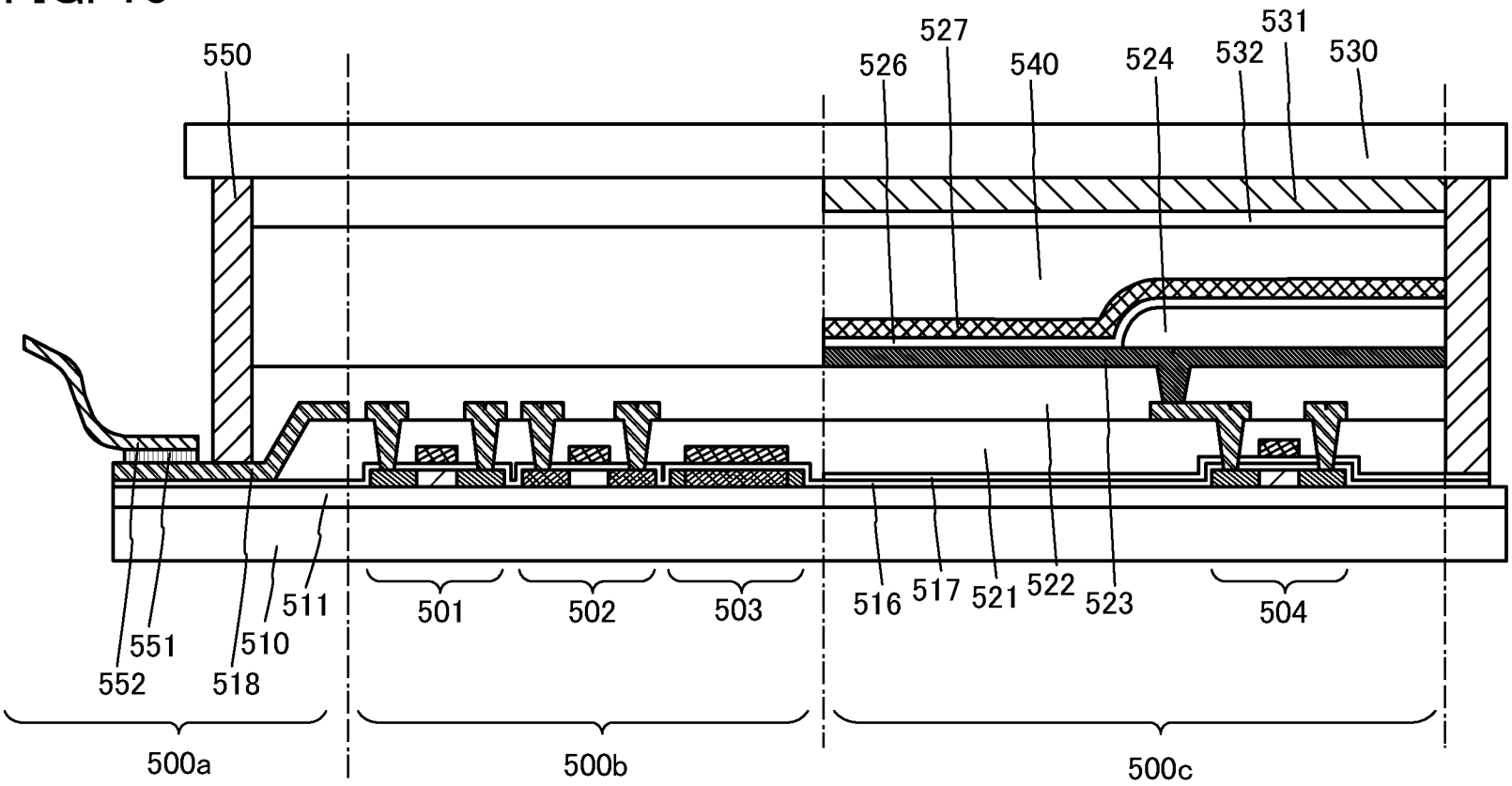
FIG. 10 illustrates an example of a structure of a display device.

FIG. 10 illustrates an example of a structure of a top-emission electroluminescent display device (also referred to as EL display device). Note that one embodiment of the present invention is not limited thereto and the display device of this embodiment may be a bottom-emission or dual-emission EL display device.

In the display device illustrated in FIG. 10, a terminal portion 500*a*, a peripheral circuit portion 500*b*, and a pixel portion 500*c* are formed over a base film 511 provided over one substrate 510.

Examples of the substrate 510 include a glass substrate, a silicon substrate, and a plastic substrate.

The base film 511 can be, for example, a layer containing an oxide insulating material or a layer containing a material such as silicon oxide, silicon oxynitride, or silicon nitride oxide. The base film 511 can also be formed by stacking layers of materials which can be used for the base film 511.

The terminal portion 500*a* is a region where connection terminals which are connected to external circuits are provided. For example, the clock signal input terminal 411, the start pulse signal input terminal 412, the data signal input terminal 413, the anode terminal 414, the cathode terminal 415, and the ground terminal 416, which are illustrated in FIG. 8, are formed in the terminal portion 500*a*.

The peripheral circuit portion 500*b* is a region where circuits which controls the operation of the pixel circuits 470 illustrated in FIG. 8 are provided. For example, the control circuit 440, the signal converter circuit 450, the source driver 461, and the gate driver 462, which are illustrated in FIG. 8, are formed in the peripheral circuit portion 500*b*.

The pixel portion 500*c* is a region where the pixel circuits 470 illustrated in FIG. 8 are provided.

The display device illustrated in FIG. 10 will be further described below.

The display device illustrated in FIG. 10 includes a transistor 501, a transistor 502, and a capacitor 503, which are provided in the peripheral circuit portion 500*b*, and a transistor 504 which is provided in the pixel portion 500*c*.

The transistor 501 and the transistor 502 are field-effect transistors having different conductivity types. For example, in the case where the transistor 501 is an n-channel transistor, the transistor 502 is a p-channel transistor. In this case, an insulating film 516 serves as a gate insulating film of the transistor 501 and the transistor 502. Note that a plurality of transistors 501 and a plurality of transistors 502 may be provided in the display device illustrated in FIG. 10. The transistor 501 and the transistor 502 are each a transistor included in any of the control circuit 440, the signal converter circuit 450, the source driver 461, and the gate driver 462.

The capacitor 503 is formed using the same semiconductor film as channel formation layers of the transistor 501 and the transistor 502, and includes a semiconductor film to which an impurity element imparting a conductivity type is added, the insulating film 516, and a conductive film formed from the same conductive film as conductive films serving as gates of the transistor 501 and the transistor 502. In this structure, the insulating film 516 functions as a dielectric layer of the capacitor 503. The capacitor 503 is included in, for example, any of the sample-and-hold circuits 452_1 to 452_Y of the signal converter circuit 450.

The transistor 504 is included in the pixel circuit 470. In this structure, the insulating film 516 and an insulating film 517 each serve as a gate insulating film of the transistor 504. For this reason, the gate insulating film of the transistor 504 is thicker than those of the transistor 501 and the transistor 502. This makes it possible to suppress a decline in the operation speed of the transistor 501 and the transistor 502 and to improve the withstand voltage of the transistor 504.

Each of the insulating film 516 and the insulating film 517 can be, for example, a layer containing a material such as silicon oxide, silicon nitride, silicon oxynitride, silicon nitride oxide, aluminum oxide, aluminum nitride, aluminum oxynitride, aluminum nitride oxide, or hafnium oxide. Further, each of the insulating film 516 and the insulating film 517 can be a stack of layers that can be used for the insulating film 516 and the insulating film 517.

As a conductive film serving as a source or a drain of each of the transistor 501, the transistor 502, and the transistor 504 or a conductive film serving as a gate thereof, for example, a layer containing a metal material such as molybdenum, titanium, chromium, tantalum, magnesium, silver, tungsten, aluminum, copper, neodymium, or scandium can be used. As the conductive film, a layer containing a conductive metal oxide can also be used. The conductive metal oxide can be, for example, a metal oxide such as indium oxide ($In_2O_3$), tin oxide ($SnO_2$), zinc oxide (ZnO), indium tin oxide ($In_2O_3$—$SnO_2$, which is abbreviated to ITO in some cases), or indium zinc oxide ($In_2O_3$—ZnO); or the metal oxide containing silicon, silicon oxide, or nitrogen. Alternatively, the conductive film can be a stack of layers of materials which can be used for the conductive film.

Further, the transistor 501, the transistor 502, and the transistor 504 each include, for example, a single crystal semiconductor film (e.g., single crystal silicon) where a channel is formed. A channel formation region of each of the transistors is formed using a single crystal semiconductor film, whereby the mobility of each of the transistor 501, the transistor 502, and the transistor 504 can be increased, which leads to an increase in operation speed of the circuit.

An example of the formation of the single crystal semiconductor film will be described below.

For example, the substrate 510 and a semiconductor substrate provided with an insulating film on its upper surface are prepared. Note that an oxide insulating film or a nitride insulating film may be formed over the substrate 510 in advance.

For example, the insulating film can be formed over the semiconductor substrate by forming an oxide insulating film by a thermal oxidation method, a CVD method, a sputtering method, or the like.

In addition, an ion beam including ions which are accelerated by an electric field enters the semiconductor substrate, so that a fragile region is formed in a region at a certain depth from a surface of the semiconductor substrate. Note that the depth at which the fragile region is formed is adjusted by the kinetic energy, mass, electrical charge, or incidence angle of the ions, or the like.

For example, ions can be injected into the semiconductor substrate with an ion doping apparatus or an ion injection apparatus.

As ions used to be injected, for example, hydrogen ions and/or helium ions can be used. For example, in the case where hydrogen ions are injected with an ion doping apparatus, the efficiency of injection of ions can be improved by increasing the proportion of $H_3^+$ in the injected ions. Specifically, it is preferable that the proportion of $H_3^+$ is higher than or equal to 50% (more preferably, higher than or equal to 80%) of the total amount of $H^+$, $H_2^+$, and $H_3^+$.

Further, the substrate 510 and the semiconductor substrate are bonded to each other with the insulating film provided on the semiconductor substrate interposed therebetween. Note that in the case where the substrate 510 is also provided with an insulating film, the substrate 510 and the semiconductor substrate are bonded to each other with the insulating film provided on the semiconductor substrate and the insulating film provided on the substrate 510 interposed therebetween. In this structure, the insulating films provided between the substrate 510 and the semiconductor substrate serve as the base film 511.

Furthermore, heat treatment is performed so that the semiconductor substrate is separated with the fragile region used as a cleavage plane. Thus, a semiconductor film can be formed over the base film 511. Note that the flatness of a surface of the semiconductor film can be improved by irradiating the surface of the semiconductor film with laser light. Further, part of the semiconductor film is etched, so that the single crystal semiconductor film can be formed.

Further, an impurity element imparting a conductivity type is added to the single crystal semiconductor film, whereby a source region and a drain region are formed. For example, an impurity element imparting n-type conductivity (e.g., phosphorus) is added in the case of an n-channel transistor, and an impurity element imparting p-type conductivity (e.g., boron) is added in the case of a p-channel transistor.

The above is the description of the example of the formation of the single crystal semiconductor film.

The display device illustrated in FIG. 10 further includes an insulating film 521 and a conductive film 518.

The insulating film 521 is provided over the transistor 501, the transistor 502, the capacitor 503, and the transistor 504. The insulating film 521 functions as a planarization film. The insulating film 521 can be, for example, an organic insulating film or an inorganic insulating film.

The conductive film 518 functions as a terminal electrode. For example, the conductive film 518 is electrically connected to a flexible printed circuit (also referred to as FPC) 552 through an anisotropic conductive film 551. For example, the conductive film 518 is formed from the same layer as the conductive films serving as the sources and the drains of the transistors 501, 502, and 504.

The display device illustrated in FIG. 10 further includes an insulating film 522, a conductive film 523 over the insulating film 522 in the pixel portion 500*c*, an insulating film 524 over the conductive film 523, a light-emitting layer 526 in contact with the conductive film 523 in an opening penetrating the insulating film 524, and a conductive film 527 over the light-emitting layer 526.

The insulating film 522 is provided over the insulating film 521 so as to cover the conductive film 518 and the conductive films serving as the source and the drain of each of the transistor 501, the transistor 502, and the transistor 504. The insulating film 522 functions as a planarization film. The insulating film 522 can be, for example, an organic insulating film or an inorganic insulating film.

The conductive film 523 is in contact with the conductive film serving as the source or the drain of the transistor 504 through an opening penetrating the insulating film 522. The conductive film 523 serves as one of a pair of electrodes of an EL element. The conductive film 523 reflects light. The conductive film 523 can be, for example, a layer containing a conductive material which reflects light and can be used for the layers in the transistor 501, the transistor 502, and the transistor 504.

The insulating film 524 is provided so as to cover a connection portion between the conductive film 523 and the conductive film serving as the source or the drain of the transistor 504. For the insulating film 524, for example, a resin material can be used.

The light-emitting layer 526 functions as a light-emitting layer of the EL element. As the light-emitting layer 526 can be, for example, a light-emitting layer formed using a light-emitting material which emits light of a specific color. The light-emitting layer 526 can also be a stack of light-emitting layers which emit light of different colors. As the light-emitting material, an electroluminescent material (also referred to as EL material) such as a fluorescent material or a phosphorescent material can be used. Alternatively, a plurality of EL materials may be used as the light-emitting material. For example, a light-emitting layer which emits white light may be formed using a stack of a layer of a fluorescent material which emits blue light, a layer of a first phosphorescent material which emits orange light, and a layer of a second phosphorescent material which emits orange light. As the EL material, an organic EL material or an inorganic EL material can be used. Alternatively, the light-emitting layer 526 may be formed using, for example, in addition to the layer containing the above-described light-emitting material, one or more of the following layers: a hole-injection layer, a hole-transport layer, an electron-transport layer, and an electron-injection layer.

The conductive film 527 serves as the other of the pair of electrodes of the EL element. The conductive film 527 transmits light. The conductive film 527 can be, for example, a layer containing a material which transmits light and can be used for the layers in the transistor 501, the transistor 502, and the transistor 504.

The display device illustrated in FIG. 10 further includes a coloring layer 531 provided over one surface of a substrate 530 and an insulating film 532 provided over the one surface of the substrate 530 with the coloring layer 531 interposed therebetween.

As the substrate 530, a substrate applicable to the substrate 510 can be used.

The coloring layer 531 serves as a color filter which transmits light with the wavelength range of red, light with the wavelength range of green, or light with the wavelength range of blue, which is included in light emitted from the EL element. Further, the coloring layer 531 may transmit cyan light, magenta light, or yellow light. The coloring layer 531 can be, for example, a layer containing a dye or a pigment. When containing a dye, the coloring layer 531 is formed by photolithography, a printing method, or an inkjet method, whereas when containing a pigment, the coloring layer 531 is formed by photolithography, a printing method, an electrodeposition method, an electrophotographic method, or the like. By using an inkjet method, for example, the coloring layer can be formed at room temperature, formed at a low vacuum, or formed over a large substrate. Since the coloring layer can be formed without a resist mask, manufacturing cost and the number of steps can be reduced.

The insulating film 532 functions as a planarization film. The insulating film 532 can be, for example, a layer of a material which can be used for the insulating film 521.

The EL element of the display device illustrated in FIG. 10 includes the conductive film 523, the light-emitting layer 526, and the conductive film 527.

Further, the EL element is sealed between the substrate 510 and the substrate 530 together with a filler 540 using a sealant 550.

As the filler 540, for example, an inert gas such as nitrogen or argon, an ultraviolet curable resin, or a thermosetting resin, can be used.

In FIG. 10, portions corresponding to the sealants 550 are represented by the same hatching pattern, and the EL element is formed in a region sealed so as to be surrounded by the sealant 550.

The above is the description of the structural example of the display device illustrated in FIG. 10.

Figure 11:
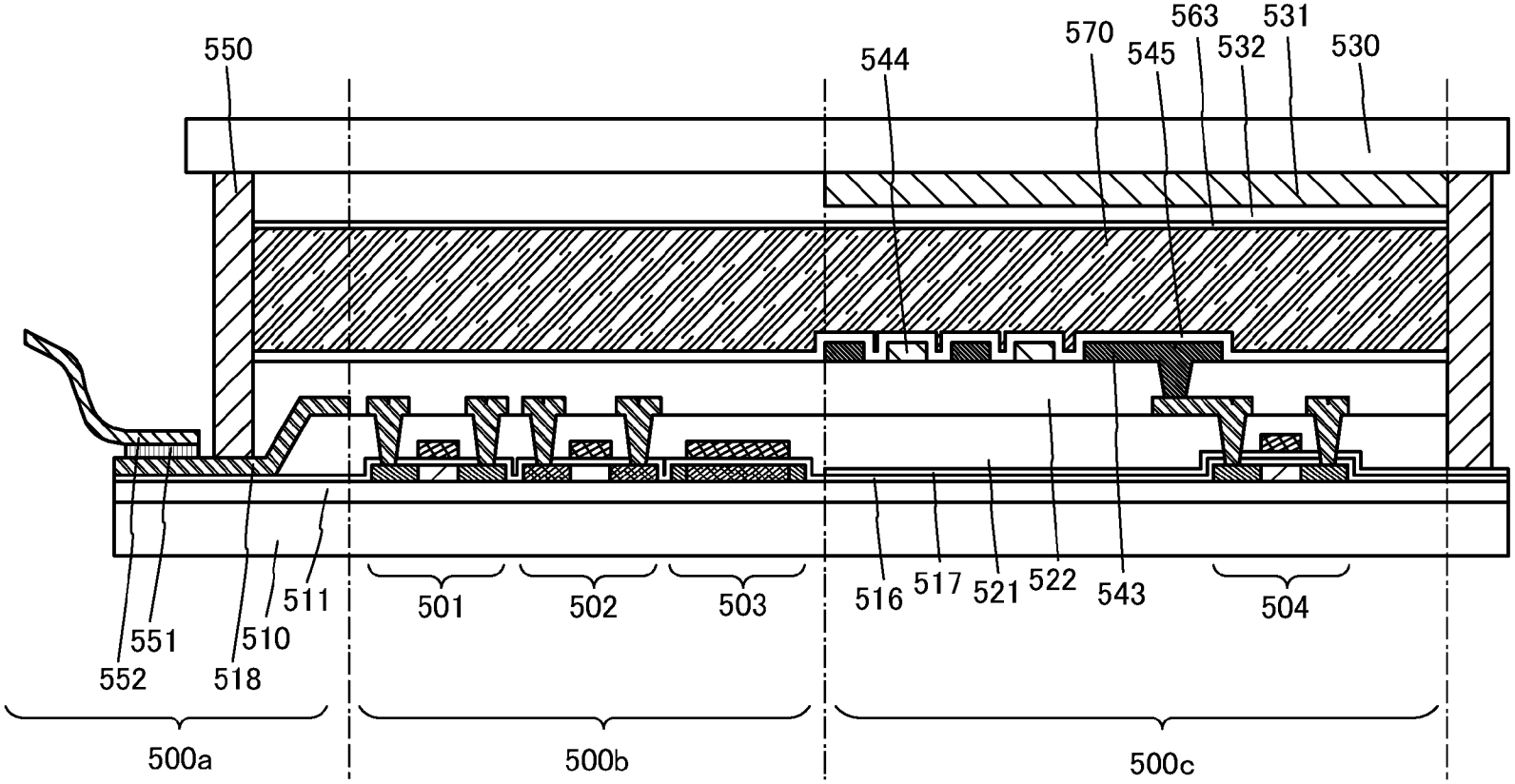
FIG. 11 illustrates an example of a structure of a display device.

Note that the display device of this embodiment is not limited to an EL display device and may be, for example, a liquid crystal display device as illustrated in FIG. 11. The application of the present invention to a liquid crystal display device allows inversion driving of a liquid crystal element.

FIG. 11 illustrates a structural example of a liquid crystal display device in a horizontal electric field mode. Note that the display device of this embodiment may be a liquid crystal display device in a vertical electric field mode without being limited thereto.

The liquid crystal display device illustrated in FIG. 11 includes a conductive film 543, a conductive film 544, an insulating film 545 provided over the conductive films 543 and 544, an insulating film 563, and a liquid crystal layer 570 instead of the conductive film 523, the insulating film 524, the light-emitting layer 526, the conductive film 527, and the filler 540, which are illustrated in FIG. 10.

The conductive film 543 and the conductive film 544 each have a comb shape. For example, the teeth of the conductive film 543 and the teeth of the conductive film 544 are alternately arranged. In FIG. 11, portions corresponding to the conductive films 543 are represented by the same hatching pattern, and portions corresponding to the conductive films 544 are represented by the same hatching pattern. Further, the conductive film 543 and the conductive film 544 overlap with the coloring layer 531. The conductive film 543 and the conductive film 544 function as a pair of electrodes of a liquid crystal element. The conductive film 543 and the conductive film 544 can be, for example, a layer of a metal oxide which transmits light. For example, a metal oxide containing indium, or the like can be used. The conductive film 543 and the conductive film 544 can be a stack of layers of materials applicable to the conductive film 543 and the conductive film 544.

The insulating film 545 and the insulating film 563 each serve as a protection layer. Each of the insulating film 545 and the insulating film 563 can be a layer of a material applicable to the insulating film 516 and the insulating film 517.

The liquid crystal layer 570 can be, for example, a layer including a liquid crystal exhibiting a blue phase.

The layer including a liquid crystal exhibiting a blue phase contains a liquid crystal composition including a liquid crystal exhibiting a blue phase, a chiral material, a liquid-crystalline monomer, a non-liquid-crystalline monomer, and a polymerization initiator. The liquid crystal exhibiting a blue phase has a short response time, and has optical isotropy that contributes to the exclusion of an alignment process and reduction of viewing angle dependence. Thus, the use of the liquid crystal exhibiting a blue phase makes it possible to operate the liquid crystal display device at a high speed. Further, one embodiment of the present invention is not limited thereto, and a liquid crystal layer containing a thermotropic liquid crystal, a low-molecular liquid crystal, a polymer liquid crystal, a polymer-dispersed liquid crystal, a ferroelectric liquid crystal, an anti-ferroelectric liquid crystal, or the like may be used. Such a liquid crystal material exhibits a cholesteric phase, a smectic phase, a cubic phase, a chiral nematic phase, an isotropic phase, or the like depending on the condition.

The liquid crystal element of the liquid crystal display device illustrated in FIG. 11 includes the conductive film 543, the liquid crystal layer 570, and the conductive film 544.

The above is the description of the display device illustrated in FIG. 11.

As described with reference to FIG. 8, FIG. 9, FIG. 10, and FIG. 11, in each of the examples of the display devices of this embodiment, the terminal portion, the peripheral circuit portion, and the pixel portion, each of which includes a transistor in which a single crystal semiconductor film is used for a channel formation region, can be formed over one substrate. Thus, the number of wirings between the respective circuits can be reduced, which can prevent poor connection or the like.

Further, in each of the examples of the display device of this embodiment, the use of the pixel circuit described in the above embodiment makes it possible to apply forward/reverse voltage or supply forward/reverse current to a display element in the pixel circuit, and the display can be statically retained in a memory provided in each pixel circuit without performing screen refresh operation, which results in lower power consumption of a driver circuit for driving a pixel.

The structures, methods, and the like described in this embodiment can be combined as appropriate with any of the structures, methods, and the like described in the other embodiments.

(Embodiment 5)

In this embodiment, examples of an electronic device in which a housing is provided with a panel including any of the display devices in Embodiment 4 will be described with reference to FIGS. 12A to 12D.

Figure 12A:
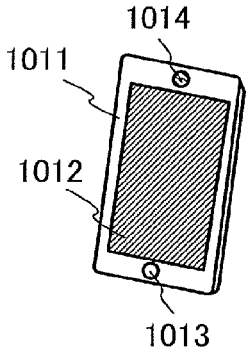
FIGS. 12A to 12D illustrate examples of electronic devices.

An electronic device in FIG. 12A is an example of a portable information terminal.

The portable information terminal illustrated in FIG. 12A includes a housing 1011, a panel 1012 incorporated in the housing 1011, a button 1013, and a speaker 1014.

Note that the housing 1011 may be provided with one of both of a connection terminal for connecting the portable information terminal illustrated in FIG. 12A to an external device and a button for operating the portable information terminal illustrated in FIG. 12A.

The panel 1012 functions as a display panel and a touch panel. The panel 1012 can be a panel formed by superposing a touch panel on any of the display devices described in Embodiment 4.

The button 1013 is provided on the housing 1011. The portable information terminal can be turned on or off by pressing the button 1013 functioning as a power button.

The speaker 1014 is provided on the housing 1011 and outputs sound.

Note that a microphone may be provided on the housing 1011, in which case the portable information terminal illustrated in FIG. 12A can function, for example, as a telephone set.

The portable information terminal illustrated in FIG. 12A has a function of, for example, one or more of a telephone set, an e-book reader, a personal computer, and a game machine.

Figure 12B:
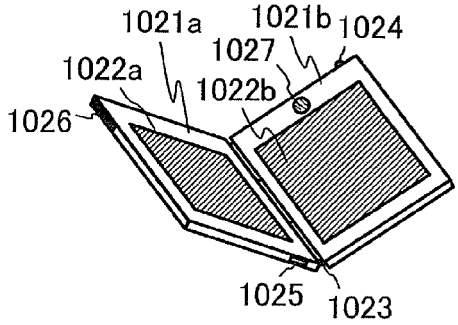

The electronic device illustrated in FIG. 12B is an example of a foldable information terminal.

The foldable information terminal illustrated in FIG. 12B includes a housing 1021*a*, a housing 1021*b*, a panel 1022*a* incorporated in the housing 1021*a*, a panel 1022*b* incorporated in the housing 1021*b*, a hinge 1023, a button 1024, a connection terminal 1025, a storage medium insertion portion 1026, and a speaker 1027.

The housing 1021*a* and the housing 1021*b* are connected by the hinge 1023.

The panels 1022*a* and 1022*b* each function as a display panel and a touch panel. Each of the panels 1022*a* and 1022*b* can be a panel formed by superposing a touch panel on any of the display devices described in Embodiment 4.

In the fordable information terminal illustrated in FIG. 12B, the housing 1021*a* can be made to overlap with the housing 1021*b*, for example, by moving the housing 1021*a* or the housing 1021*b* with the use of the hinge 1023, so that the information terminal can be folded.

The button 1024 is provided on the housing 1021*b*. Note that the button 1024 may be provided on the housing 1021*a*. For example, by pressing the button 1024 functioning as a power button, whether power is supplied to circuits in the electronic device can be controlled.

The connection terminal 1025 is provided on the housing 1021*a*. Note that the connection terminal 1025 may be provided on the housing 1021*b*. Alternatively, a plurality of connection terminals 1025 may be provided on one or both of the housings 1021*a* and the housing 1021*b*. The connection terminal 1025 is a terminal for connecting the foldable information terminal illustrated in FIG. 12B to another device.

The storage medium insertion portion 1026 is provided on the housing 1021*a*. Note that the storage medium insertion portion 1026 may be provided on the housing 1021*b*. Alternatively, the plurality of storage medium insertion portions 1026 may be provided on one or both of the housings 1021*a* and 1021*b*. For example, when a card recoding medium is inserted into the recording medium insertion portion, data can be read from the card storage medium and written to the electronic device, or data can be read from the electronic device and written to the card storage medium.

The speaker 1027 is provided on the housing 1021*b*. The speaker 1027 outputs sound. Note that the speaker 1027 may be provided on the housing 1021*a* instead of the housing 1021*b*.

Note that a microphone may be provided on the housing 1021*a* or the housing 1021*b*. When a microphone is provided, the foldable information terminal illustrated in FIG. 12B can function, for example, as a telephone set.

The foldable information terminal illustrated in FIG. 12B functions, for example, as one or more of a telephone set, an e-book reader, and a game machine.

Figure 12C:
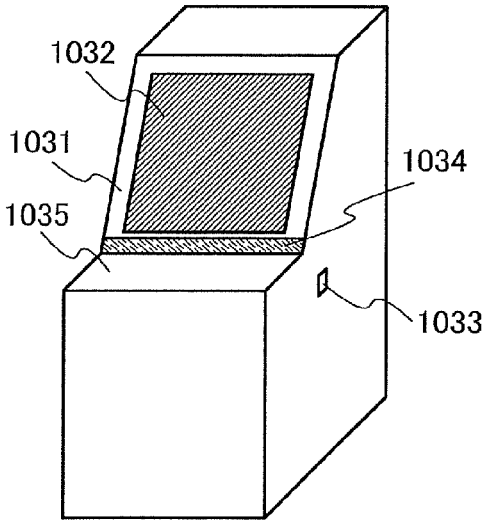

An electronic device illustrated in FIG. 12C is an example of a stationary information terminal The stationary information terminal illustrated in FIG. 12C includes a housing 1031, a panel 1032 incorporated in the housing 1031, a button 1033, and a speaker 1034.

The panel 1032 functions as a display panel and a touch panel. The panel 1032 can be a panel formed by superposing a touch panel on the display device described in Embodiment 4.

Note that the panel 1032 can be provided for a deck portion 1035 of the housing 1031.

Further, the housing 1031 may be provided with one or more of a ticket slot for issuing a ticket or the like, a coin slot, and a bill slot.

A button 1033 is provided on the housing 1031. For example, by pressing the button 1033 functioning as a power button, whether power is supplied to circuits in the electronic device can be controlled.

A speaker 1034 is provided on the housing 1031 and outputs sound.

The stationary information terminal illustrated in FIG. 12C serves, for example, as an automated teller machine, an information communication terminal for ticketing or the like (also referred to as a multi-media station), or a game machine.

Figure 12D:
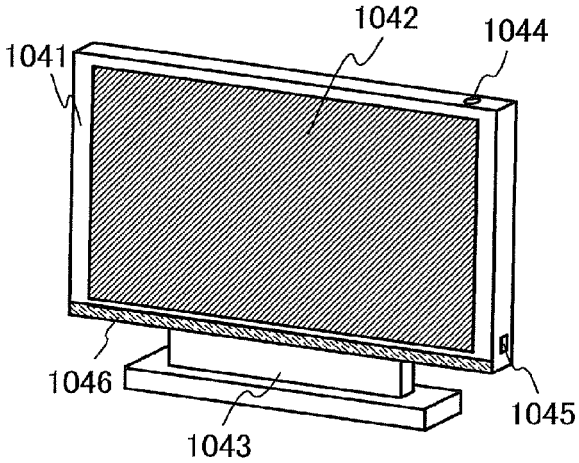

An electronic device illustrated in FIG. 12D is an example of a stationary information terminal The electronic device illustrated in FIG. 12D includes a housing 1041, a panel 1042 incorporated in the housing 1041, a support 1043 for supporting the housing 1041, a button 1044, a connection terminal 1045, and a speaker 1046.

Note that a connection terminal for connecting the stationary information terminal to an external device and/or a button for operating the stationary information terminal illustrated in FIG. 12D may be provided on the housing 1041.

The panel 1042 functions as a display panel. The display device in Embodiment 4 can be applied to the panel 1042. The panel 1042 may also function as a touch panel by superposing a touch panel on the display device described in Embodiment 4.

The button 1044 is provided on the housing 1041. For example, by pressing the button 1044 functioning as a power button, whether power is supplied to circuits in the stationary information terminal can be controlled.

The connection terminal 1045 is provided on the housing 1041. The connection terminal 1045 is a terminal for connecting the stationary information terminal illustrated in FIG.

12D to another device. For example, when the stationary information terminal illustrated in FIG. 12D is connected to a personal computer with the connection terminal 1045, the panel 1042 can display an image corresponding to a data signal input from the personal computer. For example, when the panel 1042 of the stationary information terminal illustrated in FIG. 12D is larger than a panel of an electronic device connected thereto, a displayed image of the electronic device can be enlarged, so that a plurality of viewers can easily see the image at the same time.

The speaker 1046 is provided on the housing 1041 and outputs sound.

The electronic device illustrated in FIG. 12D functions, for example, as an output monitor, a personal computer, or a television set.

As described with reference to FIGS. 12A to 12D, by using any of the display devices in Embodiment 4 for panels, operation speed can be increased and poor connection or the like in the panels can be suppressed, so that the electronic devices can have higher reliability.

The structures, methods, and the like described in this embodiment can be combined as appropriate with any of the other structures, methods, and the like described in other embodiments.

This application is based on Japanese Patent Application serial no. 2012-114506 filed with the Japan Patent Office on May 18, 2012, the entire contents of which are hereby incorporated by reference.

EXPLANATION OF REFERENCE

11: gate signal line, 12: source signal line, 13: power source line, 14: counter power source, 15: switch, 16: transistor, 17: display element, 101: gate signal line, 102: source signal line, 103: power source line, 104: counter power source, 105: switch, 106: memory, 107: transistor, 108: transistor, 109: display element, 201: gate signal line, 202: gate signal line, 203: source signal line, 204: power source line, 205: power source line, 206: power source line, 207: transistor, 208: transistor, 209: transistor, 210: transistor, 211: transistor, 212: transistor, 213: transistor, 214: transistor, 215: transistor, 216: display element, 217: counter power source, 220: memory, 221: point, 222: point, 223: point, 224: point, 301: frame period 302: subframe period 303: subframe period 304: subframe period 305: subframe period 411: clock signal input terminal, 412: start pulse signal input terminal, 413: data signal input terminal, 414: anode terminal, 415: cathode terminal, 416: ground terminal, 421: protection circuit, 422: ESD protection circuit, 423: ESD protection circuit, 431: buffer circuit, 432: buffer circuit, 440: control circuit, 450: signal converter circuit; 451: shift register, 452: sample-and-hold circuit, 461: source driver, 462: gate driver, 470: pixel circuit, 480: digital-analog signal converter circuit, 500*a*: terminal portion, 500*b*: peripheral circuit portion, 500*c*: pixel portion, 501: transistor, 502: transistor, 503: capacitor, 504: transistor, 510: substrate, 511: base film, 516: insulating film, 517: insulating film, 518: conductive film, 521: insulating film, 522: insulating film, 523: conductive film, 524: insulating film, 526: light-emitting layer, 527: conductive film, 530: substrate, 531: coloring layer, 532: insulating film, 540: filler, 543: conductive film, 544: conductive film, 545: insulating film, 550: sealant, 551: anisotropic conductive film, 552: flexible printed circuit, 563: insulating film, 570: coloring layer, 1011: housing, 1012: panel, 1013: button, 1014: speaker, 1021*a*: housing, 1021*b*: housing, 1022*a*: panel, 1022*b*: panel, 1023: hinge, 1024: button, 1025: connection terminal, 1026: storage medium insertion portion, 1027: speaker, 1031: housing, 1032: panel, 1033: button, 1034: speaker, 1035: deck portion, 1041: housing, 1042: panel, 1043: support, 1044: button, 1045: connection terminal, and 1046: speaker.

The invention clamied is:

1. A pixel circuit implementing a circuit diagram comprising:

a first transistor;

a second transistor;

a display element; and a memory comprising a first output terminal and a second output terminal, wherein:

in the circuit diagram, the first output terminal is directly connected to a gate of the first transistor;

in the circuit diagram, the second output terminal is directly connected to a gate of the second transistor;

in the circuit diagram, the display element is electrically connected to one of a source and a drain of the first transistor;

in the circuit diagram, the display element is electrically connected to one of a source and a drain of the second transistor;

in the circuit diagram, the one of the source and the drain of the first transistor is directly connected to the one of the source and the drain of the second transistor;

in the circuit diagram, the other of the source and the drain of the first transistor is directly connected to the other of the source and the drain of the second transistor; and a polarity of the first transistor is different from a polarity of the second transistor.

2. The pixel circuit according to claim 1, wherein the second output terminal is configured to output an inverted output signal of an output signal of the first output terminal.

3. The pixel circuit according to claim 2 further comprising:

a first line; and a power source, wherein:

the first line is electrically connected to the other of the source and the drain of the first transistor;

the first line is electrically connected to the other of the source and the drain of the second transistor;

the first line is configured to supply a first potential and a second potential that is a higher potential than the first potential;

a first terminal of the display element is electrically connected to the one of the source and the drain of the first transistor;

the first terminal of the display element is electrically connected to the one of the source and the drain of the second transistor;

the power source is electrically connected to a second terminal of the display element; and the power source is configured to supply a counter potential with respect to a potential being supplied to the first line.

4. The pixel circuit according to claim 3 further comprising:

a switch;

a second line; and a third line, wherein:

a first terminal of the switch is electrically connected to the second line;

a second terminal of the switch is electrically connected to the memory;

the third line is electrically connected to a third terminal of the switch; and the third line is configured to drive the switch.

5. The pixel circuit according to claim 2 further comprising:

a switch;

a second line; and a third line, wherein:

a first terminal of the switch is electrically connected to the second line;

a second terminal of the switch is electrically connected to the memory;

the third line is electrically connected to a third terminal of the switch; and the third line is configured to drive the switch.

6. The pixel circuit according to claim 1 further comprising:

a first line; and a power source, wherein:

the first line is electrically connected to the other of the source and the drain of the first transistor;

the first line is electrically connected to the other of the source and the drain of the second transistor;

the first line is configured to supply a first potential and a second potential that is a higher potential than the first potential;

a first terminal of the display element is electrically connected to the one of the source and the drain of the first transistor;

the first terminal of the display element is electrically connected to the one of the source and the drain of the second transistor;

the power source is electrically connected to a second terminal of the display element; and the power source is configured to supply a counter potential with respect to a potential being supplied to the first line.

7. The pixel circuit according to claim 6 further comprising:

a switch;

a second line; and a third line, wherein:

a first terminal of the switch is electrically connected to the second line;

a second terminal of the switch is electrically connected to the memory;

the third line is electrically connected to a third terminal of the switch; and the third line is configured to drive the switch.

8. The pixel circuit according to claim 1 further comprising:

a switch;

a second line; and a third line, wherein:

a first terminal of the switch is electrically connected to the second line;

a second terminal of the switch is electrically connected to the memory;

the third line is electrically connected to a third terminal of the switch; and the third line is configured to drive the switch.

9. A display device comprising the pixel circuit according to claim 1.

10. A panel comprising the display device according to claim 9.

11. An electronic device including the panel according to claim 10.

12. The pixel circuit according to claim 1, wherein:

in the circuit diagram, the display element is directly connected to the one of the source and the drain of the first transistor; and in the circuit diagram, the display element is directly connected to the one of the source and the drain of the second transistor.

13. A pixel circuit comprising:

a first transistor;

a second transistor;

a third transistor;

a fourth transistor;

a memory comprising:

a fifth transistor;

a seventh transistor;

an eighth transistor; and a ninth transistor;

a first line;

a second line;

a third line;

a fourth line;

a fifth line;

a sixth line;

a display element; and a power source, wherein:

one of a source and a drain of the first transistor is electrically connected to the third line and one of a source and a drain of the eighth transistor;

the other of the source and the drain of the first transistor is electrically connected to one of a source and a drain of the second transistor;

a gate of the first transistor is electrically connected to the first line;

the other of the source and the drain of the second transistor is electrically connected to one of a source and a drain of the fifth transistor, one of a source and a drain of a sixth transistor, a gate of the fourth transistor, a gate of the eighth transistor and a gate of the ninth transistor;

a gate of the second transistor is electrically connected to the second line and a gate of the seventh transistor;

one of a source and a drain of the third transistor is electrically connected to one of a source and a drain of the fourth transistor and a first terminal of the display element;

the other of the source and the drain of the third transistor is electrically connected to the other of the source and the drain of the fourth transistor and the sixth line;

a gate of the third transistor is electrically connected to a gate of the fifth transistor, a gate of the sixth transistor, the other of the source and the drain of the eighth transistor and one of a source and a drain of the ninth transistor;

the other of the source and the drain of the fifth transistor is electrically connected to the fifth line;

the other of the source and the drain of the sixth transistor is electrically connected to one of a source and a drain of the seventh transistor;

the other of the source and the drain of the seventh transistor is electrically connected to the fourth line and the other of the source and the drain of the ninth transistor;

the power source is electrically connected a second terminal of the display element; and a polarity of the third transistor is different from a polarity of the fourth transistor.

14. The pixel circuit according to claim 13, wherein:

one of the third line and the fourth line is a first power source line to which positive voltage is applied; and the other of the third line and the fourth line is a second power source line to which 0 V or negative voltage is applied.

15. The pixel circuit according to claim 14, wherein:

a polarity of each one of the first transistor, the second transistor, the fifth transistor and the eighth transistor is the same as the polarity of the third transistor; and a polarity of each one of the sixth transistor, the seventh transistor and the ninth transistor is the same as the polarity of the fourth transistor.

16. The pixel circuit according to claim 13, wherein:

a polarity of each one of the first transistor, the second transistor, the fifth transistor and the eighth transistor is the same as the polarity of the third transistor; and a polarity of each one of the sixth transistor, the seventh transistor and the ninth transistor is the same as the polarity of the fourth transistor.

17. A display device comprising the pixel circuit according to claim 13.

18. A panel comprising the display device according to claim 17.

19. An electronic device including the panel according to claim 18.

* * * * *